United States Patent [19]

Hubert

[11] Patent Number: 4,937,177

[45] Date of Patent: Jun. 26, 1990

[54] METHOD OF PREPARING AND PRINTING CUSTOM ARTWORK

[76] Inventor: Kenneth G. Hubert, 11701-4 Coastal Hwy., Ocean City, Md. 21842

[21] Appl. No.: 264,887

[22] Filed: Oct. 31, 1988

[51] Int. Cl.[5] ..... G03C 11/14

[52] U.S. Cl. ..... 430/367; 430/369; 430/320; 430/357; 355/71

[58] Field of Search ..... 430/367, 369, 320, 357; 355/77, 71, 32, 35, 38

[56] References Cited

U.S. PATENT DOCUMENTS 2,461,469 8/1944 Haff ..... 430/367

*Primary Examiner*—Paul R. Michl
*Assistant Examiner*—Thoel Chea
*Attorney, Agent, or Firm*—Sherman and Shalloway

[57] ABSTRACT

Disclosed is a method of preparing and printing custom artwork such as, for example, photo greeting cards, allowing the creation of calendars, business cards, and the like using a plurality of colors. In the method, after all of the preparatory typesetting and artwork has been completed, special color filters are adhered to the base side of the high contrast film negative which is created from the pasted-up type and artwork. These filters are chosen based upon the desired finished product colors. The final color created is the photographic complement of the filter(s) used.

10 Claims, No Drawings

METHOD OF PREPARING AND PRINTING CUSTOM ARTWORK

BACKGROUND OF THE INVENTION

The present invention relates to a method of preparing and printing custom artwork such as, for example, photo greeting cards. In the prior art, custom calendars and business cards are well known, however, to this time, no one has developed a method of preparing such products or similar products using as many different colors in their formation as is desired.

SUMMARY OF THE INVENTION

The present invention overcomes the deficiencies found in prior art methods by providing a method of preparing and printing custom artwork which includes the provision of custom formation of regions on the finished product of differing colors. The present invention includes the following interrelated aspects and features:

(a) In a first aspect, in carrying out the present method, firstly, all preparatory typesetting and artwork is carried out using a white background with black type and artwork thereon. Customarily, a paste-up sheet is employed which is customarily a piece of white paper with a grid pattern printed thereon in a light blue ink which is specially designed to be non-reproducible on the finished product.

(b) On the paste-up sheet, the type and artwork may be adhered through the use of a light adhesive allowing easy placement and removal so that repositioning may be done where necessary. A pen using ink the same color as the light blue ink used on the paste-up sheet may be employed to make notations and other markings on the paste-up sheet which will not be reproduced in the finished negative.

(c) After the paste-up work has been completed and all of the artwork and typesetting have been adhered to the paste-up sheets, a high contrast film negative must be created therefrom. These negatives are known in the art as "Kodaliths." The background of the high contrast film negative is solid black and all of the type and artwork should be extremely clear. Any scratches or dust spots in the solid black background may be filled in a manner known to those skilled in the art to prevent the appearance of dark blemishes on the products.

(d) With the high contrast film negative in hand, color is added by adhering one or more adhesive-backed colored filters to the base side of the high contrast film negative. The base side of the negative is the side which, when facing up, shows the typesetting correctly.

(e) A plurality of layers of adhesive-backed filters may be attached to the base side of the high contrast film negative depending upon desired colors. Thus, knowledge of the primary colors and the resulting colors which accrue due to the overlapping of different colors is important. Applicant has found that there is a finite limit to the number of adhesive-backed filters which may be stacked one over the other to achieve different colors. This finite limit is, in each case, the number of filters beyond which the artwork and typesetting begin to become distorted.

(f) After color has been added, the product may be color-balanced by using the standard acetate filters in a greeting card developing device and printing a greeting card or calendar while adjusting the filter pack until the contact printed photograph matches the desired result shown on test prints.

(g) Care should be taken to avoid the creation of air pockets between the negative and the adjacent glass since air pockets will cause distortions in the finished product. The use of a product known as "thin black splicing tape" and manufactured by the 3M Corporation may, for example, be used to cover all potential light leaks between the printer's light source and the photosensitive paper.

Accordingly, it is a first object of the present invention to provide a method of preparing and printing custom artwork, for example, photo greeting cards.

It is a further object of the present invention to provide such a method wherein custom artwork may be created in a multitude of colors for use in various products such as, for example, business cards and calendars.

It is a further object of the present invention to provide such a method wherein a multiplicity of colors may be used on the same finished product.

These and other objects, aspects and features will be better understood from the following detailed description of the preferred embodiment.

SPECIFIC DESCRIPTION OF THE PREFERRED EMBODIMENT

In carrying out the present method, it must be understood that after the main aspects of the method have been completed, the high contrast film negative with its colored filters thereon is printed using a machine for developing photographs as is well known in the prior art.

In carrying out the present method, the basic layout of these finished products must be created and designed. The layout may include a photograph, artwork, graphics design, and any and all subject matter capable of being photographed and reproduced. Spaces are left in the design where typesetting will be placed. The typesetting may be provided in any type style and in any size desired.

After all of the preparatory typesetting and artwork has been completed, a paste-up sheet is provided which may comprise a piece of white paper with lines or a grid pattern printed thereon in a specially created light blue ink designed to be non-reproducible when the finished paste-up is copied or shot onto a negative. In this regard, pens are well known in the prior art which use ink of the same color so that notations or other markings can be made on the paste-up sheet without fear that these notations or markings will appear in the negative which is created from the paste-up sheet.

All artwork and typesetting is provided in "camera ready" condition and on paper having a thin coating of weak adhesive on the backside thereof allowing easy removal of the copy from the paste-up sheet when it is desired to reposition the copy in the final designing of the finished product. All of the typesetting and artwork copy is provided in a black color against a white background. The light adhesive on the backside of the copy may, if desired, comprise a wax allowing weak adherence and easy removal thereof.

After all of the artwork, typesetting and other aspects of the desired finished product have been placed and aligned on the paste-up sheet, a high contrast film negative must be created therefrom. High contrast film negatives are well known in the prior art and are used in the printing to achieve the highest quality. Using the process of the present invention, the finished high contrast film negative should have the appearance of a solid black background with the type, artwork, and other aspects being clear with respect thereto. If any scratches or dust spots appear on the black background, they may be removed in a manner well known to those skilled in the art to avoid the appearance of dark blemishes on the finished product.

The heart of the present invention is the addition of color to the high contrast film negative. Color is added by adhering an adhesive-backed color filter to the base side of the high contrast film negative. As stated hereinabove, the base side of the negative is that side which, when facing up, shows the print thereon correctly.

In creating the present invention, applicant has experimented with a multiplicity of color filters and has found that most color filters commercially available today do not result in high enough quality finished products when used in preparing greeting cards, calendars, and the like. Most color filters available today do not allow the required clarity and brightness which the ultimate consumers require in such a finished product. Through careful experimentation, trial and error involving the manufacture of a multiplicity of final products using different brands of color filters, applicant has discovered that two products not designed or intended for use in methods involving photography in fact provide unexpectedly effect results in the method of the present invention.

These products are Scotchcal Translucent Film series 3630, with Scotchcal being a registered trademark of the 3M Corporation, and FORM.X.FILM , a self-adhesive vinyl film, with FORM.X.FILM being a registered trademark of the Graphic Products Corporation. While other color filters are known per se, careful experimentation to date has revealed that only these two filters provide the necessary results.

Using color filters such as those described above, color is added to the high contrast film negative by adhering one or more filter or filters to the base side of the high contrast film negative, with the base side, again, being defined as the side which, when facing upwardly, shows the typesetting correctly. The filters may be placed in layers to provide different colors, however, applicant has found that too many layers of filters may result in distortions in the typesetting or artwork. As such, care should be taken to ensure that when the desired colors have been achieved, the requisite quality in typesetting and artwork has been maintained. Generally speaking, color filters may be applied in up to four or five layers of thickness.

The filters described by the trademarks FORM.X-.FILM and Scotchcal have an adhesive-backing covered by a backing paper. The adhesive is sufficiently weak that after initial placement the filters may be easily removed and repositioned. When placed, care is taken to eliminate any air pockets by repositioning, squeezing the air out, slicing the filters with a sharp blade where necessary, and the like.

After the color filters have been applied in the required orientation, loft location, and layers to achieve the desired effects, other balancing may be accomplished by using standard acetate filters which customarily are included with a developing device. These acetate filters are used in a manner well known to those skilled in the art by printing finished products using the filters and comparing the finished product with the desired results. If the finished products differ in colors from the desired result, the acetate filters may be changed until the finished product matches the desired result. Adjustments in exposure intensity of the lamps may be carried out during this process.

The high contrast film negative with the colored filters adhered thereto is attached to the message mask assembly of the developing device in a manner avoiding any air pockets between the negative and the glass surface of the message mask assembly. Applicant has found that spraying the base side of the negative after the color filters have been attached with an adhesive such as SPRAY MOUNT , a registered trademark of the 3M Corporation, effectively avoids air pockets while allowing repositioning as desired.

In order to avoid any potential light leaks, after the negative has been finally placed and adjusted on the message mask assembly, tape may be placed over the edges of the negative to avoid any potential light leaks. A product such as thin black splicing tape, well known to those skilled in the art, may be employed.

If, after carrying out the method of the present invention as detailed above, the typesetting and/or artwork on the finished product is unsharp, minor adjustments may be made to the developing device to solve the problem. As is well known, the developing device has a pressure plate and a solenoid plunger between which a thin spacing device may be placed to decrease the amount of movement made by the pressure plate. In a further aspect, if the solenoid of the developing device encounters too much resistance from the pressure plate, distortions may result. Thus, it is important that the guide posts for the pressure plate be traveling in a clean and lubricated environment. These guide posts must be cleaned and lubricated with a dry lubricant such as, for example, silicon or powdered graphite.

In a further aspect, if there are any bends in the pressure plate, uneven pressure on the photographic paper and negative may result. If the pressure plate is not precisely flat, it must be replaced.

Of course, depending on the size of the developing device and the dimensions of the photographic paper which is to be employed, the finished product may be printed one at a time or a plurality of finished products at a time which may thereafter be separated by a cutting device.

Through the use of the teachings of the present invention, finished products may be obtained unlike those obtained anywhere in the prior art. The quality of print, the color variance and the patterns which may be easily obtained through the use of the teachings of the present invention are unparalleled in the prior art.

As such, an invention has been described in terms of a preferred embodiment thereof which fulfills each and every one of the objects of the invention as set forth hereinabove, and provides an improved method of creating artwork such as, for example, multi-colored photo greeting cards, which is highly effective, easy to reproduce, and is commercially feasible. As such, various changes, modifications, and alterations in the teachings of the present invention may be contemplated by those skilled in the art without departing from the intended spirit and scope thereof. As such, it is intended that the present invention only be limited by the terms of the appended claims.

I claim:

1. A method of preparing artwork including the steps of:

(a) providing a paste-up sheet;

(b) mounting said artwork on said paste-up sheet in a desired arrangement and orientation;

(c) creating a negative of said artwork as mounted on said paste-up sheet, said negative having a base side defined as that side of said negative which, when facing upwardly, shows an image facing correctly;

(d) adhering at least one adhesive-backed color filter to said base side of said negative which covers at least a portion of said base side; and (e) developing a photograph from said negative with said at least one color filter adhered thereto.

2. The method of claim 1, wherein said artwork includes print.

3. The method of claim 2, wherein said artwork includes photography.

4. The method of claim 1, wherein said mounting step includes the step of detachably adhering said artwork to said paste-up sheet.

5. The method of claim 1, wherein said negative comprises a high contrast film negative.

6. The method of claim 1, wherein said adhering step includes the step of adhering plural color filters in at least partially overlapping relation on said base side of said negative.

7. The method of claim 1, prior to said developing step, further including the step of removing any blemishes, spots or other imperfections from said negative.

8. The method of claim 6, wherein said plural color filters are adhered in up to five layers of thickness.

9. The method of claim 7, after said removing step, further including the step of balancing said negative.

10. The method of claim 1 wherein said adhesive-backed color filter comprises a vinyl film having a weak adhesive on one surface.

* * * * *